US006277326B1

(12) United States Patent
Vecchio et al.

(10) Patent No.: US 6,277,326 B1
(45) Date of Patent: Aug. 21, 2001

(54) PROCESS FOR LIQUID-PHASE SINTERING OF A MULTIPLE-COMPONENT MATERIAL

(75) Inventors: Kenneth S. Vecchio, San Diego; Uday V. Deshmukh, Oceanside, both of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/584,624

(22) Filed: May 31, 2000

(51) Int. Cl.[7] ..... B22F 3/12
(52) U.S. Cl. ..... 419/47; 419/39
(58) Field of Search ..... 419/47, 39; 75/247, 75/248

(56) References Cited

U.S. PATENT DOCUMENTS

| | | | | |
|---|---|---|---|---|
| 4,071,354 | | 1/1978 | Mocarski . | |
| 4,092,223 | | 5/1978 | Kaufman . | |
| 4,382,818 | | 5/1983 | Mocarski . | |
| 4,591,481 | | 5/1986 | Lueth . | |
| 4,931,241 | | 6/1990 | Freitag . | |
| 4,981,512 | * | 1/1991 | Kapoor | 75/248 |
| 4,988,386 | * | 1/1991 | Oenning et al. | 75/247 |
| 5,000,779 | | 3/1991 | German et al. . | |
| 5,098,469 | | 3/1992 | Rezhets . | |
| 5,441,553 | | 8/1995 | Polizzotti et al. . | |
| 5,698,008 | * | 12/1997 | Seki et al. | 75/247 |
| 5,776,010 | | 7/1998 | Helmstetter et al. . | |
| 5,821,441 | * | 10/1998 | Kawamura | 75/248 |
| 5,863,492 | | 1/1999 | Bose . | |
| 6,027,010 | | 2/2000 | Shira . | |
| 6,030,294 | | 2/2000 | Shira . | |
| 6,045,601 | * | 4/2000 | Tan | 75/248 |

* cited by examiner

*Primary Examiner*—Ngoclan Mai
(74) *Attorney, Agent, or Firm*—Michael A. Catania

(57) ABSTRACT

The use of liquid phase sintering for manufacturing a high density multiple component material is disclosed herein. The preferred weighting material is a multiple component material that includes a high-density component, a binding component and an anti-oxidizing component. A preferred multiple component material includes tungsten, copper and chromium. The liquid phase sintering process is preferably performed in an open air environment at standard atmospheric conditions.

23 Claims, 2 Drawing Sheets

PROCESS FOR LIQUID-PHASE SINTERING OF A MULTIPLE-COMPONENT MATERIAL

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to liquid phase sintering processes. More specifically, the present invention relates to a process for liquid phase sintering in an open air environment at standard temperatures and pressures.

2. Description of the Related Art

Sintering is a process that is primarily used to form alloy materials from a powder precursor mixture. Liquid phase sintering is a sintering process that liquefies one of the powders by heating the mixture to the melting temperature of the powder to be liquefied. Present techniques for liquid phase sintering of ternary alloys are performed in a hydrogen environment in order to reduce oxides thereby decreasing porosity and increasing the density.

An example of such a technique is disclosed in Bose, U.S. Pat. No. 5,863,492 for a Ternary Heavy Alloy Based On Tungsten-Nickel-Manganese which was originally filed in 1991. The Bose Patent discloses a process for manufacturing a kinetic energy penetrator at a sintering temperature of 1100° to 1400° C. in a dry hydrogen environment. The Bose Patent discloses densities that are 96% of the theoretical density.

Another example is Rezhets, U.S. Pat. No. 5,098,469 for a Powder Metal Process For Producing Multiphase Ni—Al—Ti Intermetallic Alloys, which was filed in 1991. The Rezhets Patent discloses a four step sintering process that includes degassing, reduction of NiO, homogenization and liquid phase sintering.

Yet another example is Kaufman, U.S. Pat. No. 4,092,223 for Copper, Coated, Iron-Carbon Eutectic Alloy Powders, which was filed in 1976. The Kaufman Patent discloses a pre-compaction, liquid phase sintering process that is performed in a hydrogen environment.

What is needed is a method to lower the processing cost of manufacturing a high density multiple component material that may be shaped for various applications.

BRIEF SUMMARY OF THE INVENTION

The present invention allows for liquid phase sintering in an open air environment and at standard atmospheric conditions. The present invention is able to accomplish this by using a multi-component material that includes an anti-oxidizing agent for the liquid phase sintering.

One aspect is a method for manufacturing a multiple component alloy through an open air liquid phase sintering process. The method includes introducing a multi-component powder/pellet mixture into a cavity on a body, and heating the multi-component powder/pellet mixture to a predetermined temperature for liquid phase sintering of the multi-component powder/pellet mixture. The predetermined temperature is above the melting temperature of one component of the multi-component powder/pellet mixture, and the process is conducted in an open air environment at standard pressure.

The multi-component powder/pellet mixture may be composed of a heavy metal component, an anti-oxidizing component and a metal binder component. One variation of the multi-component powder/pellet mixture may be composed of tungsten, copper and an anti-oxidizing component. The anti-oxidizing component may be containing alloy such as nickel-chrome, stainless steel or nickel superalloy. Preferably, the anti-oxidizing component is nickel chrome.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
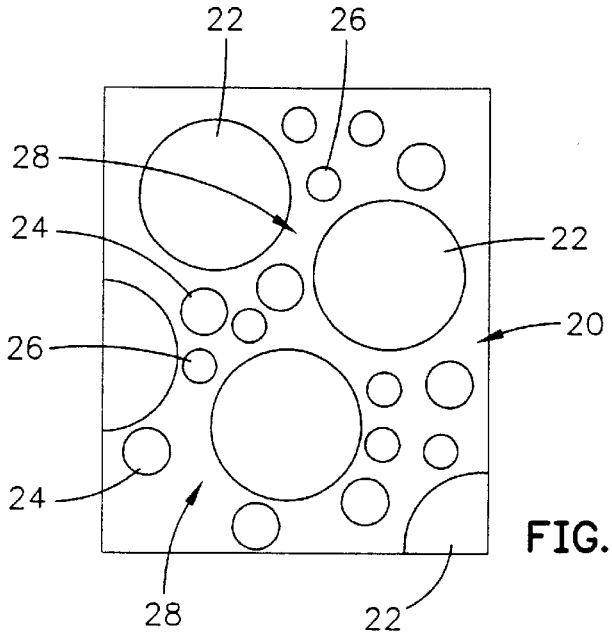
FIG. 1 is a greatly enlarged view of the precursor powder prior to compaction.
Figure 2:
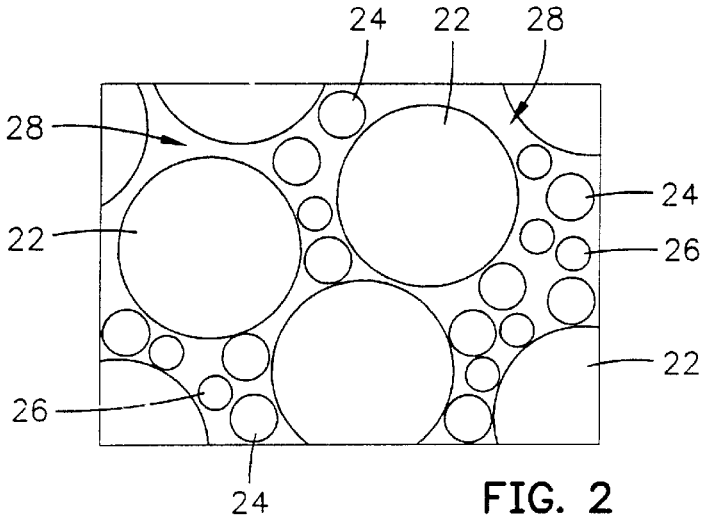
FIG. 2 is a greatly enlarged view of the precursor powder subsequent to compaction.
Figure 3:
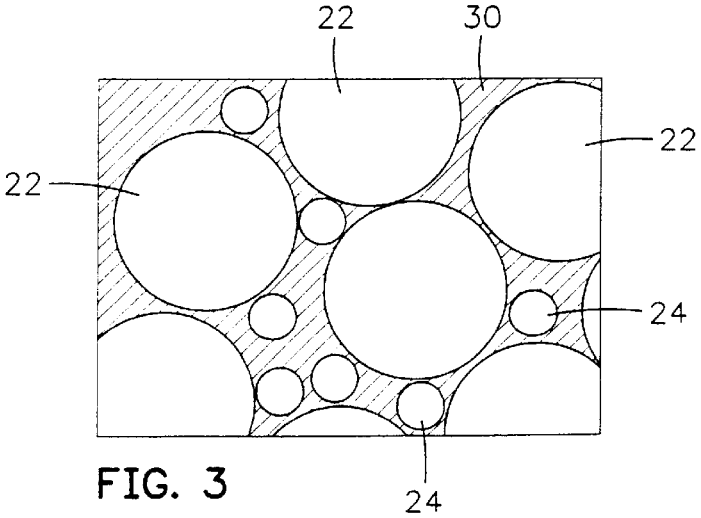
FIG. 3 is a greatly enlarged view of the precursor powder during liquid phase sintering.

FIGS. 1–3 illustrate the transformation of the powder precursor material into a high density multiple component composition. As shown in FIG. 1, a multiple component powder precursor material 20 is generally composed of a plurality of high density material particles 22, a plurality of binding component particles 24 and a plurality of anti-oxidizing component particles 26. Preferably, the high density component 22 is powder tungsten. The binding component 24 is preferably copper, and the anti-oxidizing component 26 is preferably chromium or chromium alloy. The un-compacted multiple component powder precursor material 20 also has a plurality of porosity regions 28. The greater the porosity, the lower the density.

As shown in FIG. 2, the multiple component powder precursor material 20 has been compacted, as explained in greater detail below, in order to decrease the porosity. During the liquid phase step, as shown in FIG. 3, the plurality of binding component particles (or other component) is liquefied to occupy the regions of porosity 28, and solidify to create the high density multiple component composition.

Figure 4:
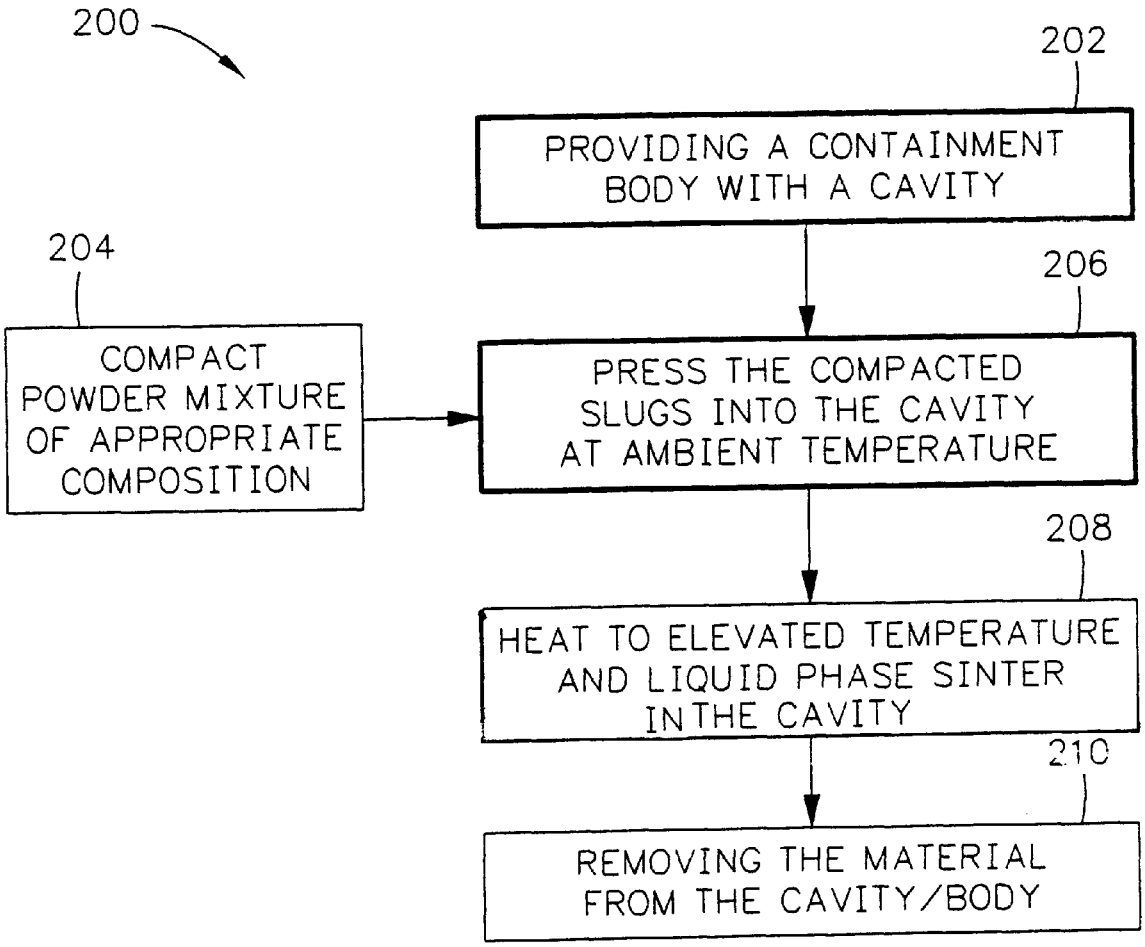
FIG. 4 is a flow chart of the process of the present invention.

FIG. 4 illustrates a flow chart of the process of the present invention for producing a high density composition from a multiple component powder or pellet mixture. The process 200 begins at block 202 with providing a containment body that has a cavity. The cavity has a predetermined shape and volume according to the needs of the high density multiple component composition. At block 204, the precursor powder materials for the multiple component powder or pellet mixture are compacted for placement into the cavity. The mixture may be composed of powders, pellets or a mixture thereof. The precursor powder or pellet materials are composed of a high-density component in various particle sizes (ranging from 1.0 mm to 0.01 mm) for achieving low porosity for the high density multiple component composition. The preferred high-density component is tungsten which has a density of 19.3 grams per cubic centimeter ("g/cm$^3$"), however other high-density materials may be used such as molybdenum (10.2 g/cm$^3$), tantalum (16.7 g/cm$^3$), gold (19.3 g/cm$^3$), silver (10.3 g/cm$^3$), and the like. Additionally, high-density ceramic powders may be utilized as the high-density component. The amount of high-density component in the mixture may range from 5 to 95 weight percent of the high density multiple component composition.

In addition to a high-density component such as tungsten, the multiple component powder or pellet mixture is composed of a binding component such as copper (density of 8.93 g/cm$^3$) or tin (density of 7.31 g/cm$^3$), and an anti-oxidizing powder such as chromium (density of 7.19 g/cm$^3$), nickel-chromium alloys (density of 8.2 g/cm$^3$), or iron-chromium alloys (density of 7.87 g/cm$^3$). The binding component in the multiple component powder or pellet mixture may range from 4 to 49 weight percent of the high density multiple component composition. The anti-oxidizing component in the alloy may range from 0.5 to 30 weight percent of the high density multiple component composition. The high density multiple component composition is preferably 90 weight percent tungsten, 8 weight percent copper and 2 weight percent chromium. The overall density of the high density multiple component composition will range from 11.0 g/cm$^3$ to 17.5 g/cm$^3$, preferably between 12.5 g/cm$^3$ and 15.9 g/cm$^3$, and most preferably 15.4 g/cm$^3$. Table one contains the various compositions and their densities.

Returning to FIG. 4, the powders are thoroughly mixed to disperse the anti-oxidizing component throughout the multiple component powder or pellet mixture to prevent oxidizing which would lead to porosity in the high density multiple component composition. The anti-oxidizing component gathers the oxides from the multiple component powder or pellet mixture to allow for the binding component to "wet" and fill in the cavities of the multiple component powder or pellet mixture. The multiple component powder or pellet mixture is preferably compacted into slugs for positioning and pressing within the cavity at block 206, and as shown in FIG. 2. Higher densities are achieved by compacting the multiple component powder or pellet mixture prior to placement within the cavity. The mixture is pressed within the cavity at a pressure between 10,000 pounds per square inch ("psi") to 100,000 psi, preferably 20,000 psi to 60,000 psi, and most preferably 50,000 psi.

Once the multiple component powder or pellet mixture, in compacted form or uncompacted form, is placed within the cavity, at block 208 the containment body is placed within a furnace for liquid phase sintering of the multiple component powder or pellet mixture under standard atmospheric conditions and in air. More precisely, the process of the present invention does not require a vacuum nor does it require an inert or reducing environment as used in the liquid phase sintering processes of the prior art. However, those skilled in the pertinent art will recognize that an inert environment or a reducing environment may be used in practicing the method of the present invention. In the furnace, the multiple component powder or pellet mixture is heated for 1 to 30 minutes, preferably 2 to 10 minutes, and most preferably 5 minutes.

The furnace temperature for melting at least one component of the mixture is in the range of 900° C. to 1400° C., and is preferably at a temperature of approximately 1200° C. The one component is preferably the binding component, and it is heated to its melting temperature to liquefy as shown in FIG. 3. However, those skilled in the art will recognize that the liquid phase sintering temperature may vary depending on the composition of the multiple component powder or pellet mixture. Preferably the binding component is copper, and the liquid phase sintering occurs at 1200° C. to allow the copper to fill in the cavities of the multiple component powder or pellet mixture to reduce porosity and thus increase the density of the high density multiple component composition. As the copper liquefies, the tungsten (melting temperature of 3400° C.), or other high-density component, remains in a powder form while the chromium or other anti-oxidizing component removes the oxides from the mixture to allow the copper to occupy the cavities and to reduce porosity caused by the oxides.

At block 210, the high density multiple component composition may be removed from the containment body, or the containment body may be removed from the high density multiple component composition. The density is manipulated through modifying the amount of high density component, such as tungsten, in the mixture as shown in Table One.

Table One illustrates the compositions of the multiple component powder or pellet mixture, the processing temperatures, the theoretical or expected density, and the calculated density. The processing was conducted at standard atmospheric conditions (1 atmosphere) and in air as opposed to the reducing environment of the prior art. The theoretical or expected density is the density if mixture was processed in a reducing environment under high pressure. The present invention is able to achieve between 70% to 85% of the theoretical density by using a method that does not require a reducing environment and high pressures.

TABLE One

| Composition | Temp. | Expected Density | Measured Density |
|---|---|---|---|
| 1. 85.0 W + 7.5 Copper + 7.5 Ni—Cr | 1200 | 17.72 | 12.595 |
| 2. 85.0 W + 7.5 Copper + 7.5 Ni—Cr | 1200 | 17.72 | 12.595 |
| 3. 85.0 W + 7.5 Copper + 7.5 Ni—Cr | 1200 | 17.72 | 12.375 |
| 4. 85.0 W + 7.5 Copper + 7.5 Ni—Cr | 1200 | 17.72 | 12.815 |
| 5. 85.0 W + 7.5 Copper + 7.5 Ni—Cr | 1200 | 17.72 | 13.002 |
| 6. 85.0 W + 7.5 Copper + 7.5 Ni—Cr | 1200 | 17.72 | 12.386 |
| 7. 85.0 W + 7.5 Copper + 7.5 Ni—Cr | 1200 | 17.72 | 13.123 |
| 8. 85.0 W + 7.5 Copper + 7.5 Ni—Cr | 1200 | 17.72 | 14.069 |
| 9. 80.0 W + 10 Copper + 10 Ni—Cr | 1200 | 17.19 | 11.935 |
| 10. 80.0 W + 7 Copper + 7 Ni—Cr + 6 Sn | 1200 | 17.1 | 12.815 |
| 11. 80.0 W + 10 Bronze + 8 Ni—Cr + 2 Sn | 1200 | 17.16 | 12.452 |
| 12. 85.0 W + 15 Sn | 300 | 17.49 | 14.454 |
| 13. 84.0 W + 14 Sn + 2 Ni—Cr | 300 | 17.4 | 14.295 |
| 14. 82.0 W + 12 Sn + 6 Ni—Cr | 300 | 17.21 | 13.695 |
| 15. 80.0 W + 18 Cu + 2 Fe—Cr | 1200 | 17.19 | 12.75 |
| 16. 80.0 W + 16 Cu + 4 Fe—Cr | 1200 | 17.16 | 12.254 |
| 17. 80.0 W + 16 Cu + 4 Fe | 1200 | 17.18 | 12.518 |
| 18. 80.0 W + 17 Cu + 3 Cr | 1200 | 17 | 12.98 |
| 19. 90.0 W + 8.75 Cu + 1.25 Ni—Cr | 1200 | 18.26 | 14.157 |
| 20. 60.0 W + 35 Cu + 5 Ni—Cr | 1200 | 15.13 | 12.991 |
| 21. 70.0 W + 26.25 Cu + 3.75 Ni—Cr | 1200 | 16.18 | 14.3 |
| 22. 80.0 W + 17.5 Cu + 2.5 Ni—Cr | 1200 | 17.22 | 14.41 |
| 23. 90.0 W + 8.75 Cu + 1.25 Ni—Cr | 1200 | 18.26 | 14.63 |
| 24. 90.0 W + 8.75 Cu + 1.25 Ni—Cr | 1200 | 18.25838 | 14.12 |
| 25. 92.0 W + 7 Cu + 1 Ni—Cr | 1200 | 18.4667 | 14.34 |
| 26. 94.0 W + 5.25 Cu + 0.75 Ni—Cr | 1200 | 18.67503 | 14.53 |
| 27. 96.0 W + 3.5 Cu + 0.5 Ni—Cr | 1200 | 18.88335 | 14.63 |
| 28. 90.0 W + 8.75 Cu + 1.25 Ni—Cr | 1200 | 18.25838 | 14.64 |

TABLE One-continued

| Composition | Temp. | Expected Density | Measured Density |
|---|---|---|---|
| 29. 92.0 W + 7 Cu + 1 Ni—Cr | 1200 | 18.4667 | 14.85 |
| 30. 94.0 W + 5.25 Cu + 0.75 Ni—Cr | 1200 | 18.67503 | 15.04 |
| 31. 96.0 W + 3.5 Cu + 0.5 Ni—Cr | 1200 | 18.88335 | 15.22 |

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for manufacturing a high-density multiple component material, the method comprising:

introducing a multiple component material into a cavity of a body, the multiple component material comprising a high-density component, a binding component and an anti-oxidizing component; and heating the multiple component material in an environment of air and at standard pressure to a predetermined liquid phase temperature for liquid phase sintering of at least one component of the multiple component material.

2. The method according to claim 1 further comprising compacting the multiple component material subsequent to introducing the multiple component material into the cavity.

3. The method according to claim 1 where in introducing the multiple component material comprises pressuring a plurality of compacts of the multiple component material into the cavity.

4. The method according to claim 1 wherein the multiple component material is in a powder form prior to heating.

5. The method according to claim 1 wherein the multiple component material comprises tungsten, copper and an anti-oxidizing component.

6. The method according to claim 5 wherein the anti-oxidizing component is selected from the group consisting of chromium, nickel-chrome, stainless steel, nickel superalloy and other chromium alloys.

7. The method according to claim 2 wherein the anti-oxidizing component is nickel chrome.

8. The method according to claim 5 wherein the tungsten component is 5–90 weight percent of the multiple component material, the copper component is 5–40 weight percent of the multiple component material, and the anti-oxidizing component is 0.5–10 weight percent of the multiple component material.

9. The method according to claim 1 wherein the high-density component is selected from the group consisting of tungsten, molybdenum, tantalum and gold.

10. The method according to claim 1 wherein the heating is performed at a temperature between 900° C. and 1400° C.

11. A method for manufacturing a ternary material, the method comprising:

introducing a multiple component material into a cavity of a body, the multiple component material comprising a high-density component, a binding component and chromium or a chromium alloy component;

compacting the multiple component material within the cavity of the body; and heating the multiple component material in an environment of air and at standard pressure to a liquid phase temperature of the binding component of the multiple component material.

12. The method according to claim 11 wherein the high density component is 5–90 weight percent of the multiple component material, the binding component is 5–40 weight percent of the multiple component material, and the chromium or chromium alloy component is 0.5–10 weight percent of the multiple component material.

13. The method according to claim 11 wherein the high-density component is selected from the group consisting of tungsten, molybdenum, tantalum, silver and gold.

14. The method according to claim 11 wherein the heating is performed at a temperature between 900° C. and 1400° C.

15. The method according to claim 11 wherein the compacting is performed at a pressure of between 20,000 psi to 100,000 psi.

16. A method for manufacturing a ternary material, the method comprising:

providing a multiple component material, the multiple component material comprising powder tungsten, powder copper and powder chromium or powder chromium alloy component;

heating the multiple component material to a temperature between 900 °C. and 1400° C.; and sintering the multiple component material to form the ternary material.

17. The method according to claim 16 wherein the tungsten is 5–90 weight percent of the multiple component material, the copper is 5–40 weight percent of the multiple component material, and the chromium or chromium alloy component is 0.5–10 weight percent of the multiple component material.

18. The method according to claim 11 further comprising compacting the multiple component material at a pressure of between 20,000 psi to 100,000 psi.

19. The method according to claim 16 wherein the ternary alloy has a density between 13.0 g/cm$^3$ to 15.5 g/cm$^3$.

20. The method according to claim 16 further comprising mixing the multiple component materials.

21. The method according to claim 16 wherein the heating is performed in an environment of air and at a pressure of one atmosphere.

22. The method according to claim 16 wherein the heating is performed in a reducing environment.

23. The method according to claim 16 wherein the heating is performed in an inert environment.

* * * * *